United States Patent [19]

Rice

[11] 3,952,474

[45] Apr. 27, 1976

[54] METHOD OF ASSEMBLING BUILDING STRUCTURES

[76] Inventor: Edward K. Rice, 2077 Linda Flora Drive, Los Angeles, Calif. 90024

[22] Filed: Mar. 12, 1973

[21] Appl. No.: 340,391

Related U.S. Application Data

[62] Division of Ser. No. 837,986, June 2, 1969, Pat. No. 3,744,200.

[52] U.S. Cl. ..... 52/747; 264/228

[51] Int. Cl.[2] ..... E04B 1/348; E04G 21/14

[58] Field of Search ..... 52/747, 223, 227–229, 52/745, 747, 234, 236; 264/228, 229

[56] References Cited

UNITED STATES PATENTS

| | | | |
|---|---|---|---|
| 1,397,976 | 11/1921 | McAvoy | 52/227 |
| 2,635,451 | 4/1953 | Walthers | 52/227 |
| 2,684,589 | 7/1954 | Perreton | 52/228 |
| 3,260,025 | 7/1966 | Van Der Leley | 52/228 |

FOREIGN PATENTS OR APPLICATIONS

| | | | |
|---|---|---|---|
| 778,542 | 2/1968 | Canada | 52/236 |
| 591,494 | 8/1947 | United Kingdom | 52/228 |

*Primary Examiner*—James L. Ridgill, Jr.
*Attorney, Agent, or Firm*—Lyon & Lyon

[57] ABSTRACT

A method of assembling building structures utilizing precast concrete building units which are positioned side-by-side and end-to-end as well as stacked to form a multistory structure; the units being secured together by tendons freely threaded through horizontal and vertical chases provided in the building units, placed under tension and anchored at their extremities.

4 Claims, 17 Drawing Figures

METHOD OF ASSEMBLING BUILDING STRUCTURES

This application is a division of an application filed June 2, 1969, Ser. No. 837,986 entitled PRECAST CONCRETE BUILDING CONSTRUCTION which issued July 10, 1973 U.S. Pat. No. 3,744,200.

BACKGROUND OF THE INVENTION

Heretofore it has been the practice to embed steel reinforcing in concrete and establish an intimate bond between the reinforcing and concrete throughout the entire surface of the reinforcing. This practice has been followed in the techniques of pretensioning and post-tensioning of concrete. In the pretensioning technique, the reinforcing tendons are held in tension while the concrete is poured around the reinforcing. In the post-tensioning technique, the reinforcing tendons are jacketed in sleeves large enough to permit sliding movement of the tendons. Then, after the concrete is set, the tendons are tensioned, grouting is forced between the tendons and the sleeves so that the grouting is bonded to the tendons and the tendons are anchored at their extremities.

In all cases, there is a continuous intimate bond between the reinforcing or tendon and the concrete or grouting. If the concrete or grouting cracks, localized stress is applied to the reinforcing or tendon; that is, the reinforcing or tendon is stressed over the width of the crack (plus some relatively small bond length at each side of the crack). As a result, the crack need only widen a small amount to stretch the short length of the reinforcing or tendon beyond the yield point of the steel. If the force which caused the crack is relieved, the reinforcing or tendon does not recover, and the reinforcing or tendon exerts at least a local force tending to widen the crack.

Should the force which creates the crack or a later force be of sufficient magnitude, the crack may widen sufficiently that the localized stress in the reinforcing or tendon exceeds the ultimate strength of the steel and a rupture occurs.

This problem is fully recognized so that in designing a concrete structure using ordinary reinforcing or tendon reinforcing, care is taken that the expected loads will be insufficient to produce the cracks. This, of course, materially increases the cost of construction, especially if the designer must consider gross overloads such as produced, for example, by earthquakes or falling aircraft.

SUMMARY OF THE INVENTION

The present invention is directed to a method which provides a solution of the problem and involves other advantages as summarized as follows:

A primary object is to provide a method of assembling multistory building structure wherein precast building units having tendon passageways arranged in end-to-end and side-by-side relation as well as stacked, and then are connected by horizontal and vertical tendons slidably received in the passageways and anchored only at their ends. As a result, the tendons are free to distribute throughout their length the force resulting from any change due to a crack of series of cracks. Thus, a crack of a width sufficient to fail a bonded tendon causes only minor stress change throughout the length of the unbonded tendon.

Figure 1:
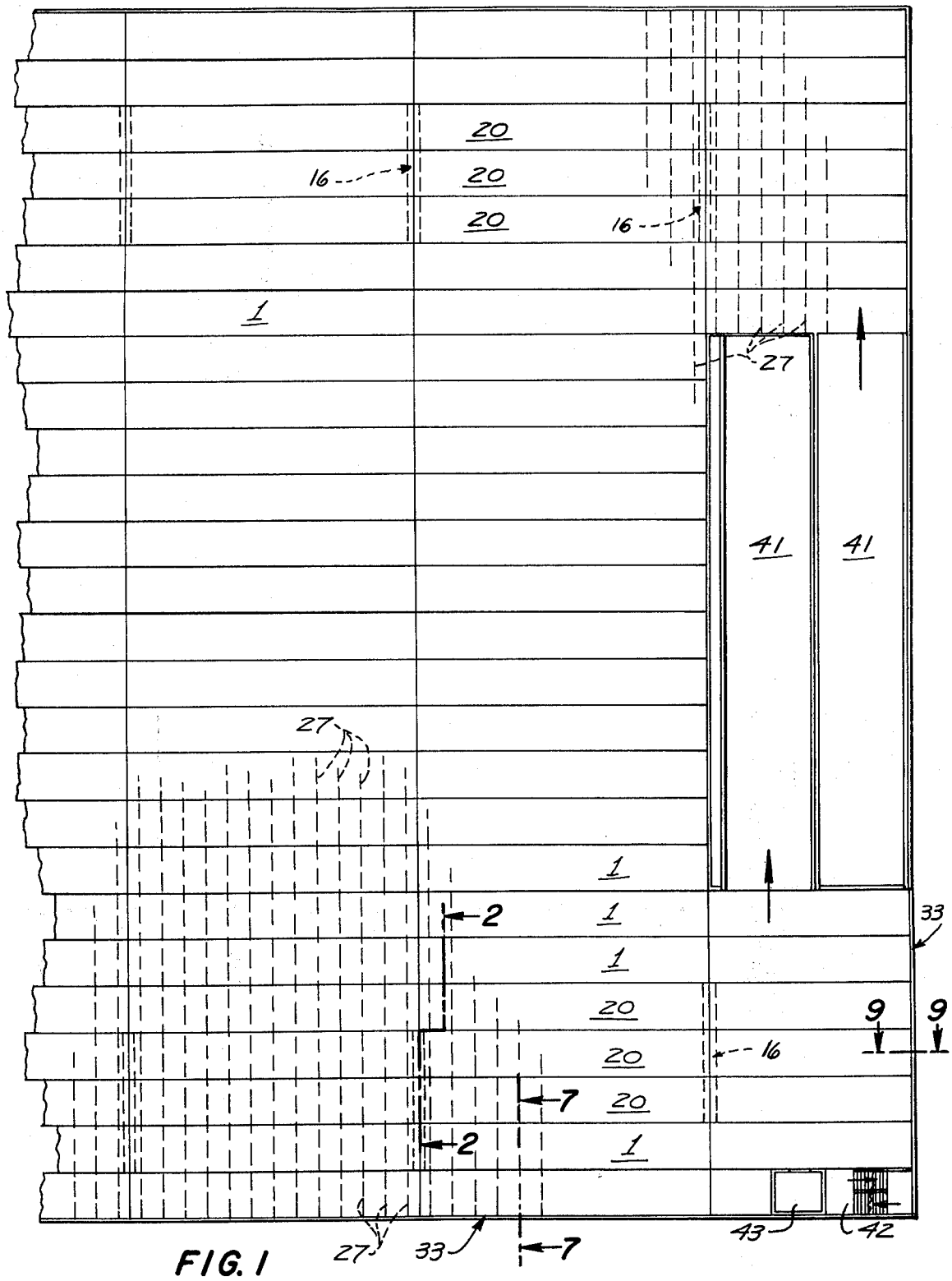
FIG. 1 is a plan view, showing a deck of the building construction as adapted for use as a multistory parking structure.

The building construction illustrated is a multilevel parking garage, and is constructed principally by the assembly of three sets of building units. The first set of building units, designated 1, includes an elongated rectangular slab or deck member 2, formed of reinforced concrete. The slab may also be termed a floor-ceiling slab, as it forms the ceiling of the level below and the floor of the level above. Depending from the slab, along the longer margins thereof, is a pair of longitudinal beams 3. Transverse beams 4 are provided at the ends of the slab. Extending downwardly from the beams, at the corners of the slab, are legs 5.

The slab is provided with a set of transverse tendon passages 6. The legs are provided with vertical tendon passages 7. The longitudinal beams 3 are provided with tendon passages 8.

Several tendon passages may be provided in each beam and may merge at their central portions. The passages are curved, essentially in catenary profile. Each passage 8 receives a tendon 9, in the form of a steel cable, which extends through anchor plates 10 set in the ends of the longitudinal beams. The anchor plates are provided with tapered openings which receive anchor wedges 11 that grip the ends of the tendons.

The passages 8 may be formed in several ways, such as by a sleeve or liner cast in place, or by a rod of elastomeric material capable of being extracted after the concrete has been cast and set; or, the tendon itself may be coated with a lubricant, or encased in a sleeve. Regardless of the method employed, the tendon remains slidable in the passage so that the tendon may be posttensioned by use of conventional pulling tools applied to the exposed extremities of the tendons. Later, the tendons are cut so that grout 12 may fill the recess in which the anchor plate is located.

Figure 16:
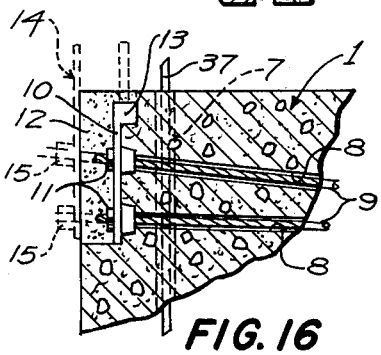
FIG. 16 is an enlarged fragmentary sectional view, taken through 16—16 of FIG. 2.

In order to handle the building unit, each anchor plate may be provided with a lifting boss 13, which may be grasped by a suitable lifting fitting, or may be internally screwthreaded to receive a lifting bolt. Alternatively, before the grout is applied, and the ends of the tendons trimmed, the protruding ends may receive lifting plates 14, held in place by removable clamping collars 15, all as indicated in FIG. 16.

Each of the second set of building units, designated 16, includes a beam 17, similar in depth but of greater width than the longitudinal beams of a first building unit. Each beam 17 is provided with longitudinal tendon passages, tendons and anchor plates as described in connection with the longitudinal beam 3. Each beam 17 is provided with end legs 18, similar to the corner legs 5, but having approximately twice the cross section. Also, each beam 17 is provided with slide notches 19, intended to accommodate the ends of third building units 20. Each building unit 20 includes a slab 2, corresponding to the first building unit, as well as longitudinal beams 3; that is, the transverse end beams 4 and corner legs 5 are omitted. Also, the ends of the longitudinal beams are notched, as indicated by 21, in order to fit the notches 19 of the building unit 16.

Figure 2:
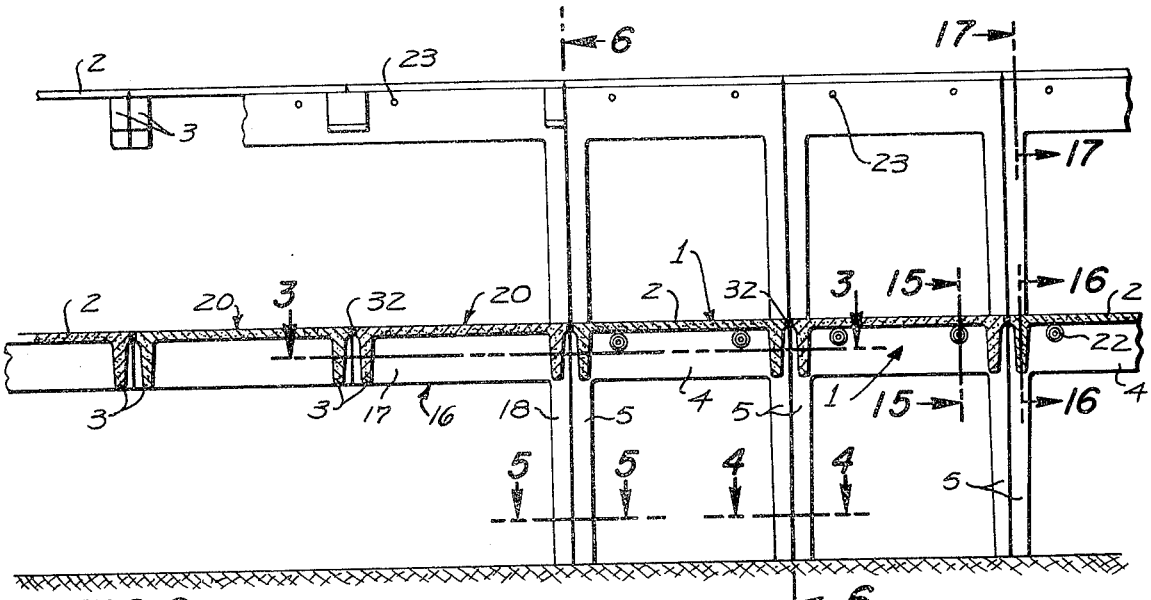
FIG. 2 is an enlarged fragmentary sectional view, taken through 2—2 of FIG. 1, illustrating a two-story parking structure.
Figure 3:
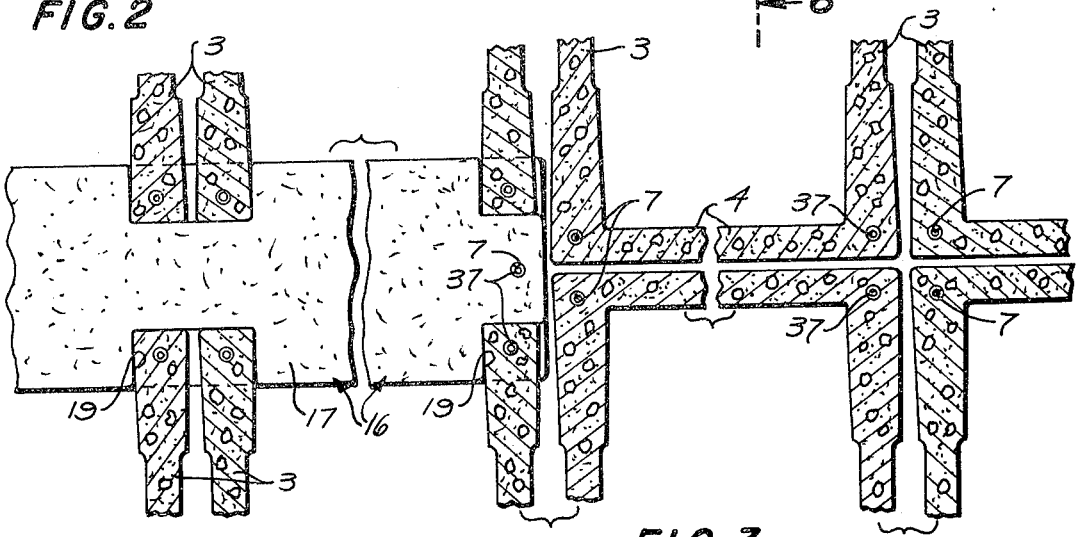
FIG. 3 is a further enlarged fragmentary sectional view, taken through 3—3 of FIG. 2, portions being shown in plan.
Figure 6:
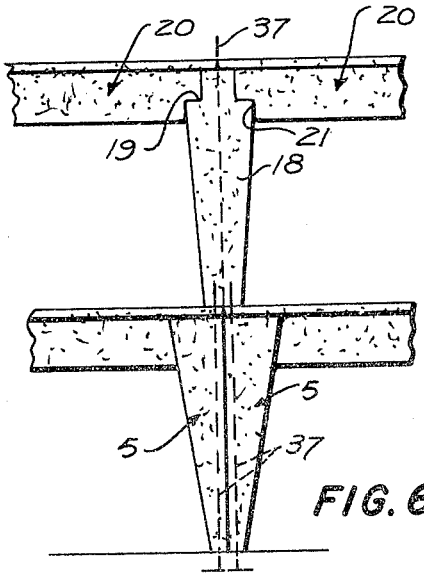
FIG. 6 is a fragmentary elevational view, taken from 6—6 of FIG. 2.
Figure 5:
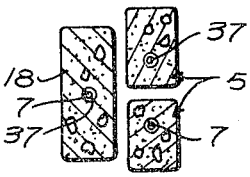
FIG. 5 is another sectional view, taken through 5—5 of FIG. 2.
Figure 4:
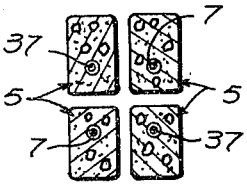
FIG. 4 is an enlarged sectional view, taken through 4—4 of FIG. 2.
Figure 7:
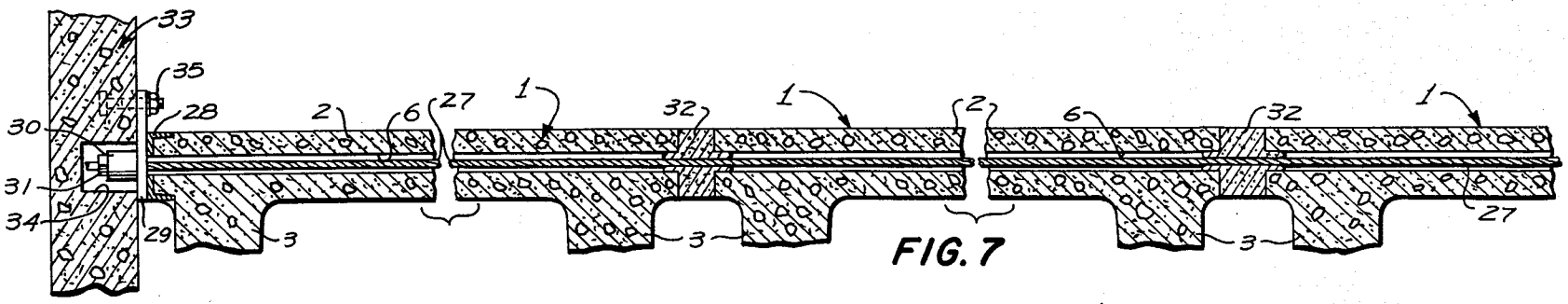
FIG. 7 is an enlarged fragmentary sectional view, taken through 7—7 of FIG. 1.
Figure 8:
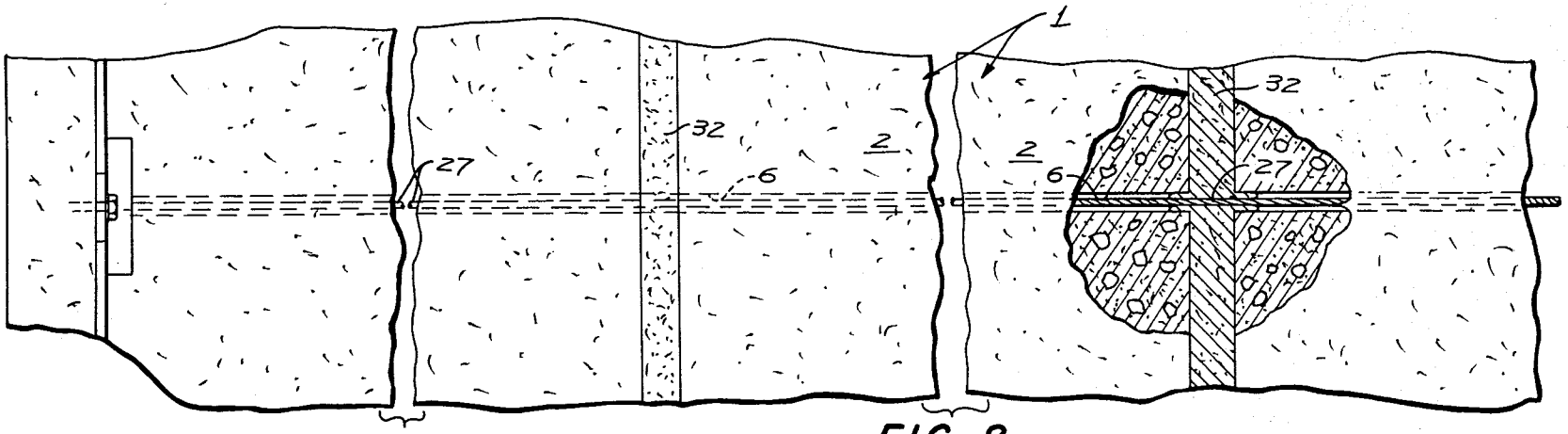
FIG. 8 is a fragmentary plan view of the portion of the building structure shown in FIG. 7.
Figure 10:
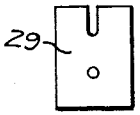
FIG. 10 is a side view of one of the anchor plates.

The three sets of building units are assembled by placing members of the first set of building units in end-to-end and side-by-side relation. It is impractical to make the building units 1 of sufficient width to provide space for vehicles between the corner legs at each end. However, the length of each building unit 1 is sufficient to accommodate two rows of parked cars and a passageway therebetween. In order to provide passageways parallel to the longitudinal axes of the building units 1, the second building units 16 are placed in lateral alignment with the adjacent ends of selected building units 1, and the building units 20 are placed between the beams 17 of the building units 16 and suitably secured thereto, thereby forming a deck which is a continuation of the deck formed by the slabs 2 of the first building units, as shown in FIGS. 1, 2 and 3.

Figure 15:
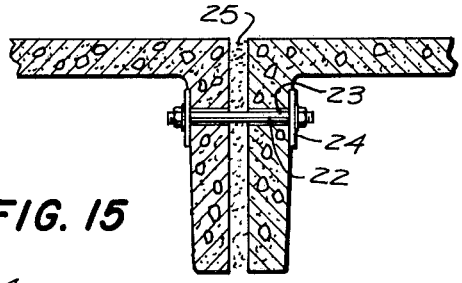
FIG. 15 is an enlarged fragmentary sectional view, taken through 15—15 of FIG. 2.

As shown in FIG. 15, the first building units are secured in end-to-end relation by tie bolts 22, which extend through openings 23 provided in the end beams 4. The tie bolts receive load distributing flanges 24. Before applying nuts to the ends of the tie bolts 22, grout 25 is forced in the space between the ends of adjacent units. It is preferred to provide such grout space rather than placing the building units in abutting relation as such spacing compensates for tolerance variations.

The building units 1 as well as the building units 20 are placed in side-by-side relationship in such a manner that their transverse tendon passages 6 are placed in alignment. The passages 6 may be circular, but to provide tolerance compensation, they may be oval or rectangular. Each aligned row of passages 6 receives a transverse tendon 27, which extends continuously from one outside edge to the opposite outside edge of the building structure. The building units forming such edges are provided with exposed metal channel members 28 bonded to the concrete as well as secured by suitable reinforcing, not shown. Each end channel is perforated to receive an end of the corresponding tendon. An anchor plate 29, perforated to receive the corresponding tendon, overlies the end channel 28. Mounted on each anchor plate or arranged to bear thereagainst is a wedge collar 30, which receives a set of conical wedges 31 adapted to grip and hold the tendon under tension.

As is the case between the ends of the building units, the sides thereof are not placed in mutual contacting relation, but space is provided therebetween to compensate for tolerance variations. Such spaces also aid in insertion or threading of the tendons 27 into the passages 6. For, in the case of partial misalignment, the end of the tendon may be guided into alignment with a succeeding passage. After the tendons 27 have been inserted, and before tension is applied, grout 32 is forced into the spaces between the sides of the building units. Temporary forms may be inserted upwardly between adjacent longitudinal beams 3 so as to retain the grout 32 in the space provided. It should be noted that the tendons 27 are thoroughly greased or otherwide coated so that any bond between the tendons 27 and the grout is minimized.

It should be further noted that the groot 25 and 12 preferably contains an expansive cement, such as the cement disclosed in U.S. Pat. Nos. 3,215,701 and 3,303,037. The grout mixture is compounded so that it swells slightly or at least compensates for any shrinkage that would otherwise occur so that on tensioning the tendons 27, there is no significant reduction in the overall distance between the extreme building units.

Figure 9:
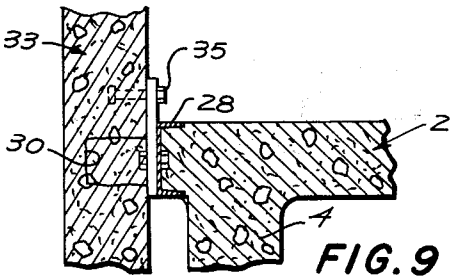
FIG. 9 is an enlarged fragmentary sectional view, taken through 9—9 of FIG. 1.
Figure 11:
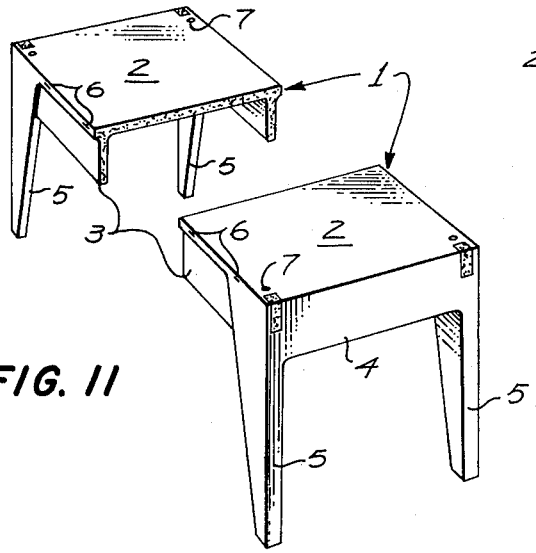
FIG. 11 is a fragmentary perspective view, showing one of the building units used in the building construction.
Figure 12:
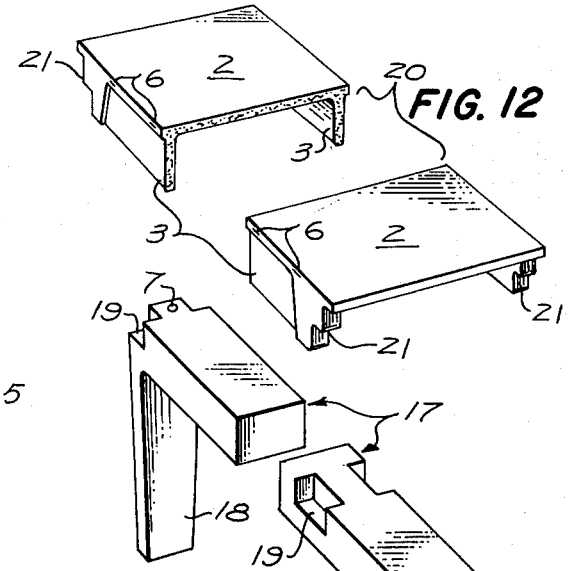
FIG. 12 is a fragmentary perspective view, showing another of the building units.
Figure 13:
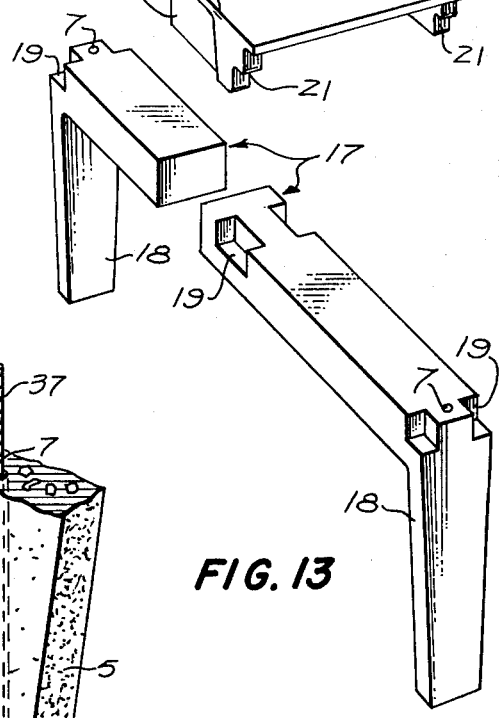
FIG. 13 is a fragmentary sectional view, showing another of the building units.

Each anchor plate 29 may also serve to support in part a fence wall unit 33, each fence wall unit consisting essentially of a rectangular concrete slab having sockets 34 to clear the wedge collars 30, and also provided with mounting bolts 35 which are received in slots provided in upper portions of the anchor plates 29, which portions project above the slab 2. At the end extremities of the building units forming the ends of the building, mounting plates identical to the anchor plates 29 may be used and may be bolted to the end channel members 28, as indicated in FIG. 9.

Figure 14:
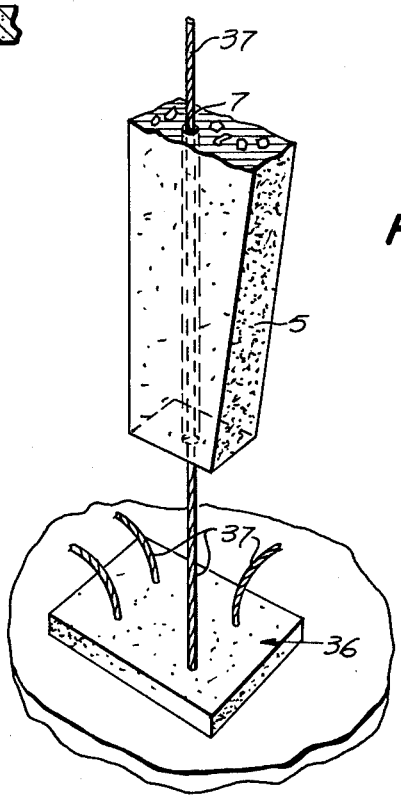
FIG. 14 is a fragmentary perspective view, showing a supporting leg and a portion of the foundation as well as a vertical tendon, the leg being separated from the foundation to illustrate the construction.
Figure 17:
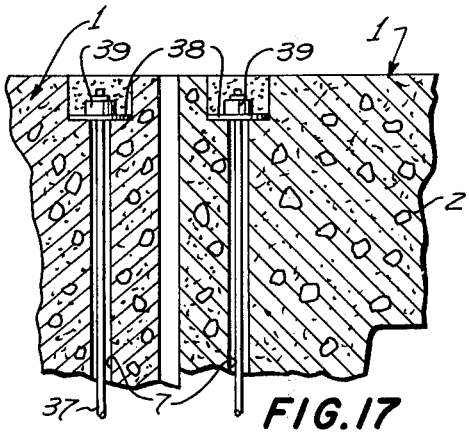
FIG. 17 is an enlarged fragmentary sectional view, taken through 17—17 of FIG. 2.

The building units legs 5 and 18 of the lower or first level of building units rest on appropriate foundation piers 36, indicated in FIG. 14. Vertical tendons 37, having conventional fixed anchorages, are secured in the foundation piers 36 and extend upwardly therefrom. The vertical tendons 37 are anchored at the time the foundation is poured, and are initially formed in coils until assembly of the building construction is undertaken. The building units 1 and 16 are poised above the foundation piers and the vertical tendons are threaded therethrough; that is, the end legs 18 and corner legs 5 are threaded downward on the vertical tendons, the tendons being received in the vertical tendon passages 7. After the building units have been assembled, anchor plates 38 are fitted over the protruding upper ends of the vertical tendons and appropriate wedge collars 39 and wedges 40 are applied, and the tendons are tensioned in a conventional manner. It is preferred, of course, to place the anchor plates 38, wedge collars 39 and wedges 40 below the upper surface of the upper deck of the structure so that the upper deck is free for use for parking purposes.

The parking structure includes appropriately located ramps 41 which may be formed of modifications of the building units described, or may be conventional in construction. Also, suitable stairways 42 and elevator shafts 43 are provided.

It should be noted that each of the building units contain conventional reinforcing, not shown, in addition to the tendon reinforcing described. Also, if desired, the building units may contain expansive cement capable of stressing the reinforcing, or to compensate for shrinkage, or conventional cement may be used. While use in the individual units of reinforcing bonded to the concrete does create a localized stress condition in the reinforcing, the problem is not as severe as would be the case with the building as a whole.

It will also be noted that where the ramps 41 would interfer, the tendons 27 terminate at the ramps.

While a two story parking structure is indicated, the structure may be extended to greater height.

Should it be desired to do so, the building construction may be disassembled. That is, the tendons 27 may be removed as well as the bolts 22, and the top anchors 39. Then, the building units may be removed, those units having legs being raised from the tendons 37. The grout 25 and 32 is first removed, or, if it is intended to provide for later disassembly, the contacting surfaces of the building units are provided with a suitable parting agent; or, a non-adhering material is substituted for the grout. In this regard, it should be noted that the grout is maintained under compression so that there is no need for a bond with the building units.

A known property of conventional concrete has been that if a concrete slab is sufficiently compressed in two directions within the plane defined by the slab, the slab becomes waterproof; that is, water does not penetrate from one surface through the slab to the opposite surface. The required compressive force has been determined to be about 300 psi in each direction. Such compression has been attained by sets of tendons extending in each direction, which have been posttensioned. If expansive cement, such as that disclosed in U.S. Pat. Nos. 3,215,701 and 3,303,037, is used, part of such compression is attained by the interaction of the reinforcing as more fully disclosed in the aforementioned patent application, Ser. No. 662,602. In this case, less supplementary posttensioning force, for example, is required in order to attain the waterproof condition.

It has been accepted that in order to attain such waterproof condition the compression loads must be applied simultaneously or nearly so and soon after the concrete has attained proper strength.

It has been found in the course of developing the present invention, that the compression loads need not be applied as nearly simultaneously as possible or as soon as possible after casting. Instead, it has been found that the longitudinal tendons 9 in each building unit may be posttensioned at any convenient time; further, the building units may be stored for a long period before being assembled into the building structure and subjected to the transverse compression force exerted by the tendons 27 and when finally comp-essed in the order of 300 psi in the two axes, the slab becomes watertight.

Also previously it has been considered essential that the compressive forces be confined to a single monolithic unit; whereas, it has been found that a large number of slabs placed side-by-side may be compressively stressed by a series of tendons threaded therethrough and be rendered watertight.

With regard to the grout, if this includes a conventional portland cement base with or without expansible ingredients, it has been found that if compressed in the order of 300 psi in a single transverse axis between the ends or the sides of the slabs, it as well as the interfaces between the grout and the slabs becomes watertight.

While particular embodiments of this invention have been shown and described, it is not intended to limit the same to the details of the constructions set forth, but instead, the invention embraces such changes, modifications and equivalents of the various parts and their relationships as come withing the purview of the appended claims.

I claim:

1. A method of assembling a multiple story building utilizing precast concrete modules each having one elongated slab and at least one beam extending the length thereof and legs at the ends of the beam, the legs having free lower ends terminating in generally planar end surfaces and having vertical tendon guideways extending therethrough and through the ends of the beams and slabs, the method characterized by:

a. preparing a foundation with tendons each having an end anchored therein;

b. raising a module over said foundation sufficiently to permit threading corresponding anchored tendons in its guideways;

c. threading said tendons through said guideways;

d. lowering said module along said threaded tendons until said end surfaces abut a supporting surface;

e. raising and lowering succeeding modules and threading said tendons through the guideways thereof to form a stack of modules, wherein the legs of succeeding modules rest on the slabs of preceding modules;

f. and applying tension force throughout the length of each tendon protruding from the uppermost module and reacting said tension force against the uppermost module to simultaneously apply throughout the stack of modules a corresponding compression force sufficient to provide a frictional bond between the end surfaces of the legs of the modules with respect to the underlying surface of the foundation and preceding modules.

2. A method, as defined in claim 1, wherein the modules have horizontal tendon guideways extending transversely through their slabs, the method being further characterized by:

a. disposing a plurality of the modules with their horizontal guideways in alignment;

b. threading tendons through the horizontal guideways;

c. and applying tension throughout the length of each horizontal tendon to simultaneously apply throughout said plurality of modules a corresponding transverse compression force to provide a frictional bond between the confronting edges of the slabs.

3. A method of assembling a building structure utilizing modules having elongated slabs provided with transverse guideways therethrough, characterized by:

a. placing a set of modules with their slabs in side-to-side relation, their guideways in alignment and their adjacent edges slightly spaced apart;

b. threading tendons through the aligned guideways;

c. anchoring one end of each of the tendons adjacent an edge surface of the slabs of said set of modules;

d. filling the spaces between said adjacent edges with grout;

e. applying tension loads at the non-anchored extremity of each of the tendons to effect uniform distribution of the tension loads throughout the tendons between their extremities and reacting said tension loads against said modules to thereby apply opposing transverse compression loads to the extreme edge surfaces of the set of slabs for uniform distribution of the transverse compression loads throughout the slabs of the set of modules;

f. and maintaining the tension load at a level to effect mutual bonding engagement between the edges of the slabs and said grout while maintaining the tendons in slidable relation to the slab guideways to distribute extraneous loads between the slabs and along the tendons.

4. A method of assembling a building structure, as defined in claim 3, utilizing modules including slabs having supporting legs containing vertical tendon guideways, further characterized by:

a. placing a plurality of module sets with the supporting legs in a plurality of vertical columns and their guideways in vertical alignment;

b. threading vertical tendons through the vertical guideways;

c. anchoring the extremities of the tendons in each column with respect to the extremities of the columns;

d. applying tension loads at the anchored extremities of the vertical tendons in each column while permitting distributed sliding movement of the tendons in their vertical guideways to effect uniform distribution of the tension loads throughout the tendons between their anchored extremities and thereby;

e. apply an opposing compression load to the extremities of the corresponding column for uniform distribution of compression loads throughout the legs comprising the column;

f. and maintaining the tension load at a level to effect mutual bonding engagement between the extremities of the legs of the surfaces therebelow and maintaining the vertical tendons in slidable relation to their vertical guideways to distribute extraneous loads between the legs and along the vertical tendons.

* * * * *